US006299421B1

(12) United States Patent
Oh et al.

(10) Patent No.: US 6,299,421 B1
(45) Date of Patent: Oct. 9, 2001

(54) OIL SUPPLY APPARATUS OF LINEAR COMPRESSOR

(75) Inventors: Won Sik Oh, Seoul; Hyeong Kook Lee, Kunpo, both of (KR)

(73) Assignee: LG Electronics, Inc. (KR)

( * ) Notice: Subject to any disclaimer, the term of this patent is extended or adjusted under 35 U.S.C. 154(b) by 0 days.

(21) Appl. No.: 09/524,128

(22) Filed: Mar. 13, 2000

(30) Foreign Application Priority Data

Sep. 8, 1999 (KR) ..... 99-38149

(51) Int. Cl.[7] ..... F04B 39/10; F04B 39/00; F04B 17/04

(52) U.S. Cl. ..... 417/571; 417/557; 417/562; 417/417

(58) Field of Search ..... 417/571, 557, 417/562, 417, 211, 199.1; 184/6

(56) References Cited

U.S. PATENT DOCUMENTS 5,993,175 * 11/1999 Kim et al. ..... 417/417
6,024,544 * 2/2000 Kim et al. ..... 417/417
6,089,836 * 7/2000 Seo ..... 417/417
6,220,393 * 2/2001 Oh et al. ..... 184/6.16

* cited by examiner

*Primary Examiner*—Charles G. Freay
*Assistant Examiner*—Michael K. Gray
(74) *Attorney, Agent, or Firm*—Ostrolenk, Faber, Gerb & Soffen, LLP

(57) ABSTRACT

An oil supply apparatus of a linear compressor including an oil feeder frame having an oil cylinder, an oil suction hole communicated with the oil cylinder and an oil discharge hole; an oil cover combined to the oil feeder frame to cover the oil cylinder and having an oil suction opening selectively communicated with the oil suction hole and an oil communication space selectively communicated with the oil cylinder and the oil discharge hole; an oil piston positioned between the oil feeder frame and the oil cover, being inserted in the oil cylinder and performing a slidable reciprocal movement to suck and discharge oil; and a single oil valve positioned between the oil cover and the piston. In the apparatus, only one oil valve is used to reduce the parts in number and facilitate the assembling of the valve, and does not contact other structure during its operation of the opening and closing so that a proper amount of oil can be constantly supplied.

7 Claims, 7 Drawing Sheets

OIL SUPPLY APPARATUS OF LINEAR COMPRESSOR

BACKGROUND OF THE INVENTION

1. Field of the Invention

The present invention relates to an oil supply apparatus of a linear compressor, and more particularly, to an oil supply apparatus of a linear compressor in which only one valve is used to suck and discharge oil, thereby reducing the number of parts and facilitating assembling of the valve.

2. Description of the Background Art

As is known, a linear compressor is an equipment for compressing a coolant by directly reciprocating a piston by means of a magnet and a coil instead of a crank shaft.

FIG. 1 shows a linear compressor in accordance with a conventional art. As shown in the drawing, the linear compressor includes a compression unit C installed in a horizontal direction inside a casing V filled with oil at its bottom, for sucking, compressing and discharging, and a oil feeder 0 fixedly combined at the outside of the compression unit C, to provide oil to each contact sliding portion (sliding portion) of elements.

As shown in FIG. 2, the oil feeder O includes a oil cylinder 21 attached onto the bottom surface of the compression unit C, a oil piston 22 inserted in the oil cylinder 21 and dividing the inner space of the oil cylinder into a suction space and a discharge space; a first and a second oil springs 23*a* and 23*b* positioned at both ends of the oil piston 22 to elastically support the oil piston 22; a oil suction valve 24 contacted to an oil outlet of the oil piston 22 and supported by the second oil spring 23*b*; and a oil discharge valve 25 installed at a oil outlet of the oil cylinder 21.

In detail, the oil suction valve 24 is inserted inside the oil cylinder 21, and compressively supported by the second oil spring 23*b* at the end portion of the oil outlet of the oil piston, so as to selectively open and close an oil flow path 22*a* of the oil piston 22.

The oil piston 22 is inserted in the oil cylinder 21 in a manner that its outer surface slidably contact the inner surface of the oil cylinder 21, in which the oil flow path 22*a* is formed in a lengthy direction to communicate the inlet and the outlet of the oil cylinder 21.

Reference numerals 1 denotes a frame, 1*a* denotes an oil inflow path, 1*b* denotes a first oil pocket, 1*d* denotes a oil circulation path, 1*e* denotes an oil discharge hole, 3 denotes a cylinder, 3*a* denotes an oil opening, 4 denotes an inside/outside lamination assembly, 5 denotes a magnet assembly, 6 denotes a piston, 7 denotes a suction valve, 9 denotes a suction pipe, 11 denotes a discharge cover, 12 denotes a discharge valve, 13 denotes a valve spring, 26 denotes a suction cover, 27 denotes a discharge cover, S1 denotes a suction space, and S2 denotes a discharge space.

Operation of the oil supply apparatus of the linear compressor constructed as described above in accordance with the conventional art will now be explained.

When the compression unit C is oscillated along with a magnetic assembly 5 in a horizontal direction by a linear reciprocal movement of the magnetic assembly 5, that is, an rotor of a linear motor, the oscillation is transferred to the oil cylinder 21 fixed at the compression unit C, so that the oil cylinder 21 is reciprocally moved.

In this respect, since the oil piston 22 is slidably inserted in the oil cylinder 21, oil is sucked and discharged by the inertial force resulted from the reciprocal movement of the oil cylinder 21.

That is, when the oil cylinder 21 is moved in the 'P' direction as shown in FIG. 3A, the oil piston 22 overcomes the elasticity of the second oil spring 23*b* and is moved in the 'Q' direction to thereby push the oil charged in the discharge space S2 in the 'Q' direction, while oil flows in to be charged in the suction space S1 between the oil piston 22 and the oil suction cover 26.

At this time, the oil suction valve 24 is closed, closing the oil flow path 22*a* of the oil piston22, while the oil discharge valve 27 is pulled back in the 'Q' direction to thereby open the discharge side of the oil cylinder 21.

Reversely, in case that the oil cylinder 21 is moved in the 'Q' direction in FIG. 3B, the oil piston 22 overcomes the first oil spring 23*a* and is moved in the 'P' direction, so that the pressure of the discharge space S2 becomes relatively low compared to that of the suction space S1 and the oil of the suction space S1 flows to the discharge space S2.

At this time, the oil suction valve 24 is turned to open in the 'Q' direction, while the oil discharge valve 27 is turned in the 'P' direction, closing the discharge side of the oil cylinder 21 to thereby prevent the oil from flowing backward.

However, as to the oil supply apparatus of the linear compressor of the conventional art, since the number of parts constructing the oil feeder is too many, the number of assembly process is increased, causing a problem in that its productivity is deteriorated.

In addition, since the oil suction valve controlling inputting and outputting of the oil is so small, its fabrication and assembling is very difficult.

Moreover, the opening and closing portion of the oil suction valve contacts the compressive coil spring supporting the oil piston, opening and closing operation of the oil valve is not made smoothly, failing to control properly the input and outputting of the oil.

SUMMARY OF THE INVENTION

Therefore, an object of the present invention is to provide an oil supply apparatus of a linear compressor which is capable of improving a productivity by reducing assembly holes in number by reducing the number of parts for construction of the oil supply apparatus.

Another object of the present invention is to provide an oil supply apparatus of a linear compressor by which a productivity and assembly of a valve controlling inputting and outputting of oil is facilitated, and the valve does not contact any other structure during its opening and closing so that a proper amount of oil is constantly supplied.

To achieve these and other advantages and in accordance with the purposed of the present invention, as embodied and broadly described herein, there is provided an oil supply apparatus of a linear compressor including an oil feeder frame having an oil cylinder, an oil suction hole communicated with the oil cylinder and an oil discharge hole; an oil cover combined to the oil feeder frame to cover the oil cylinder and having an oil suction opening selectively communicated with the oil suction hole and an oil communication space selectively communicated with the oil cylinder and the oil discharge hole; an oil piston positioned between the oil feeder frame and the oil cover, being inserted in the oil cylinder and performing a slidable reciprocal movement to suck and discharge oil; and a single oil valve positioned between the oil cover and the piston.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
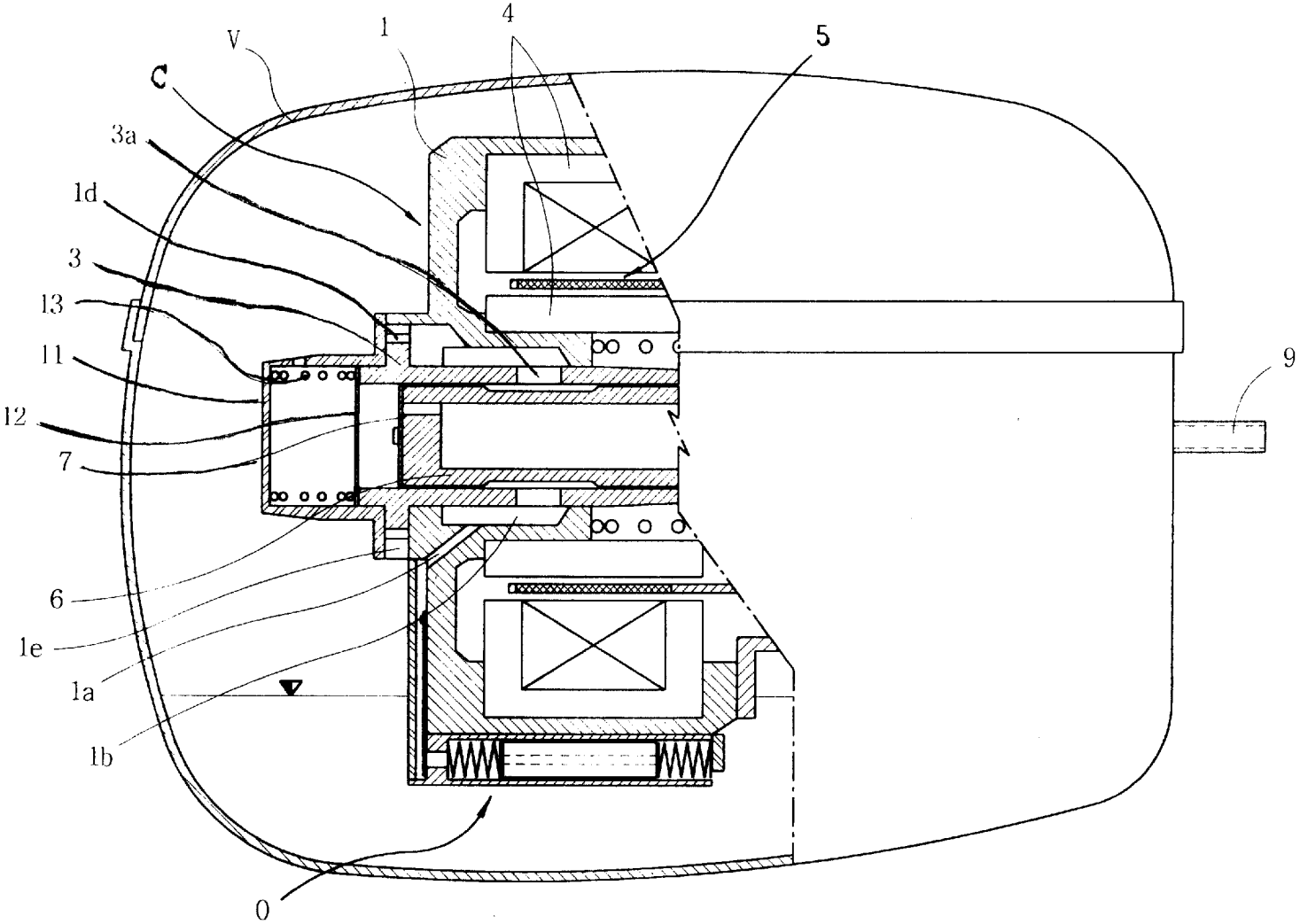
FIG. 1 CONVENTIONAL ART
FIG. 1 is a partial vertical-sectional view of a linear compressor in accordance with a conventional art.
Figure 2:
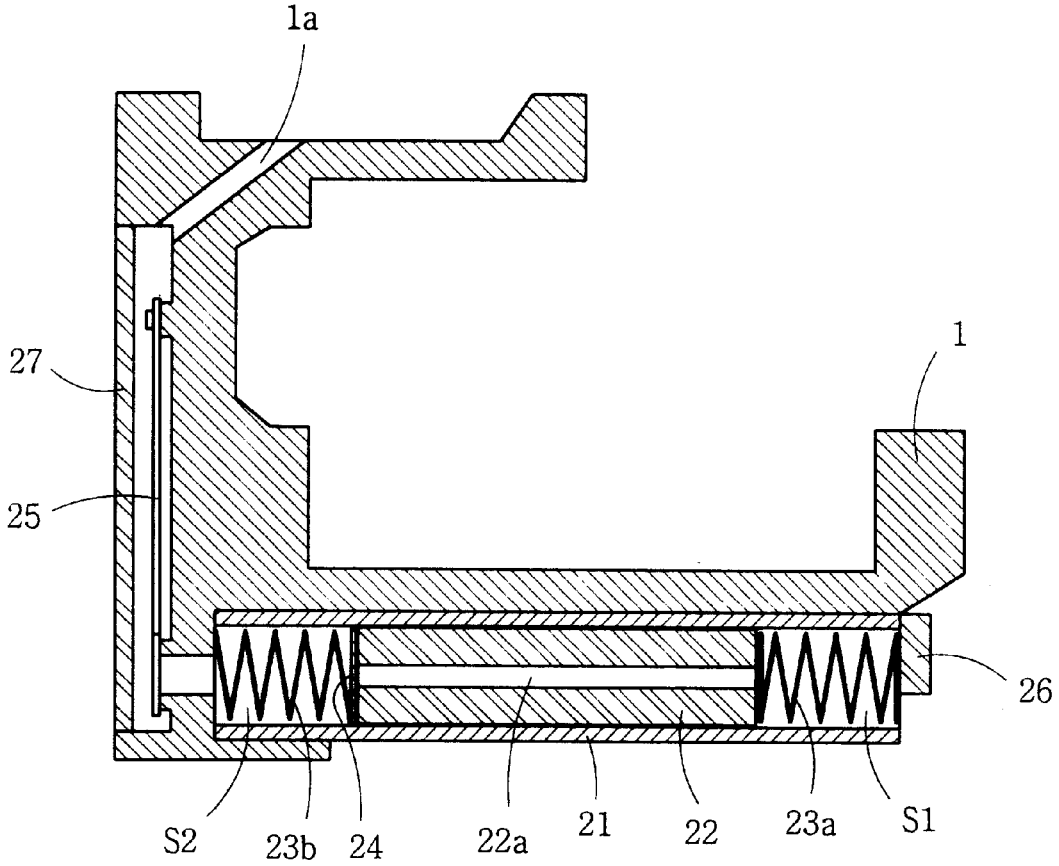
FIG.2 CONVENTIONAL ART
FIG. 2 is an enlarged vertical-sectional view of an oil feeder and an oil inflow path of the linear compressor in accordance with the conventional art.
Figure 3A:
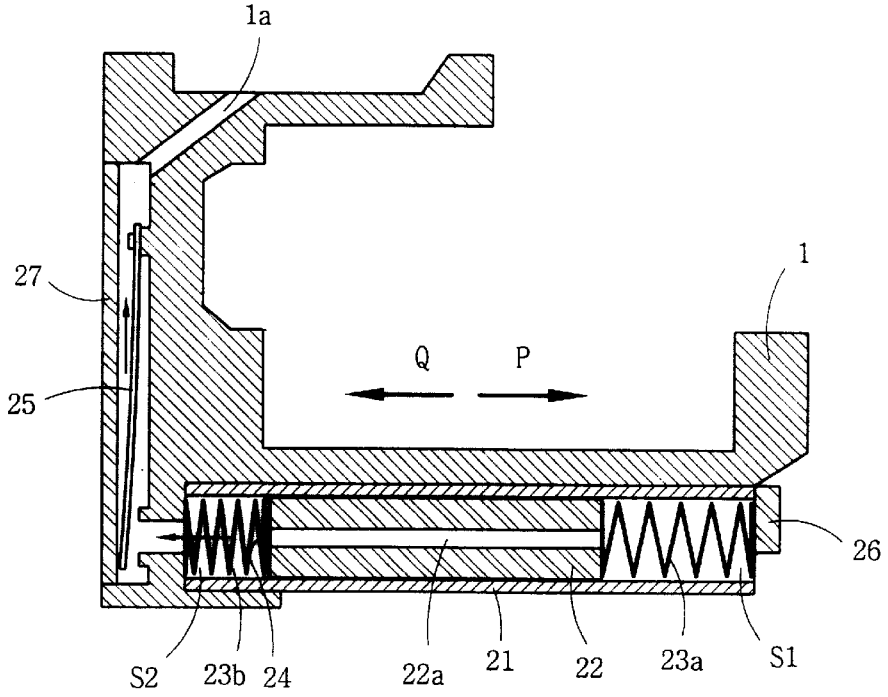
FIG.3A CONVENTIONAL ART
FIG. 3A is a vertical-sectional view showing an operation that oil flows into an oil suction path in an oil supply apparatus of the linear compressor in accordance with the conventional art.
Figure 3B:
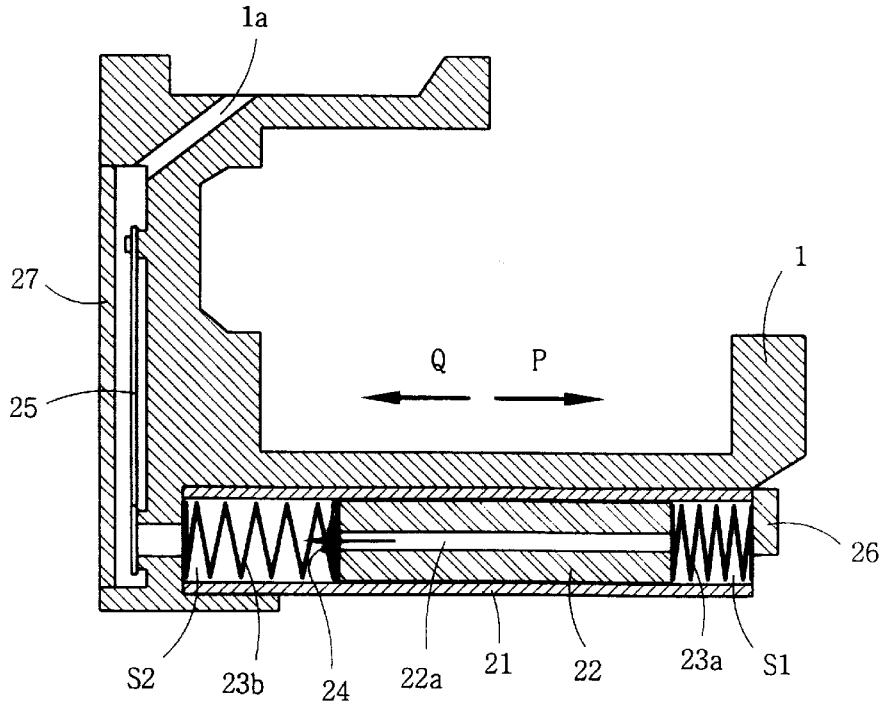
FIG.3B CONVENTIONAL ART
FIG. 3B is a vertical-sectional view showing an operation that oil flows into a discharge space of an oil cylinder in the oil supply apparatus of the linear compressor in accordance with the conventional art.
Figure 4:
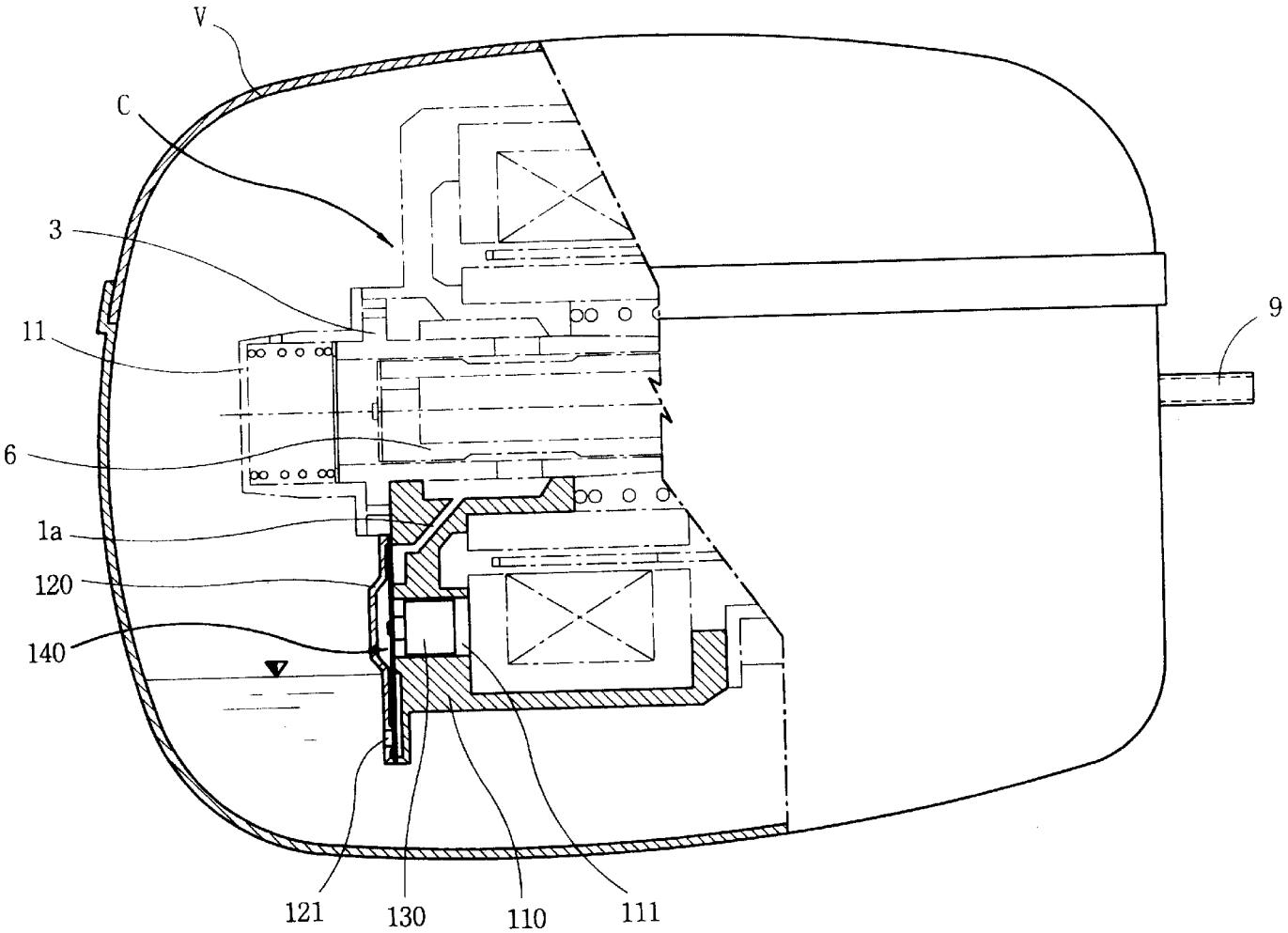
FIG. 4 is a partial vertical-sectional view of a linear compressor provided with an oil supply apparatus in accordance with the present invention.
Figure 5:
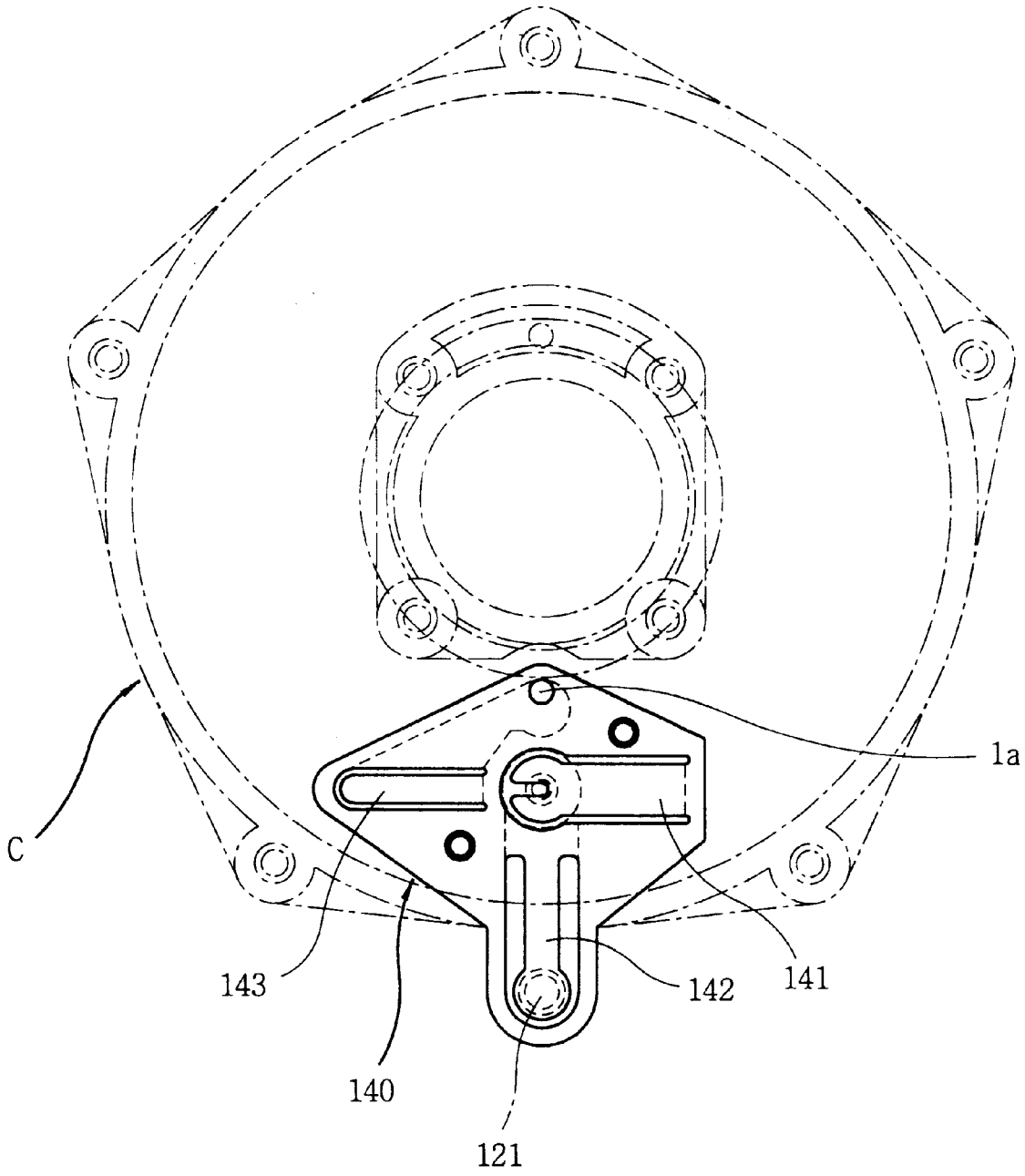
FIG. 5 is a front view of a compression unit provided with the oil supply apparatus of the linear compressor in accordance with the present invention.
Figure 6:
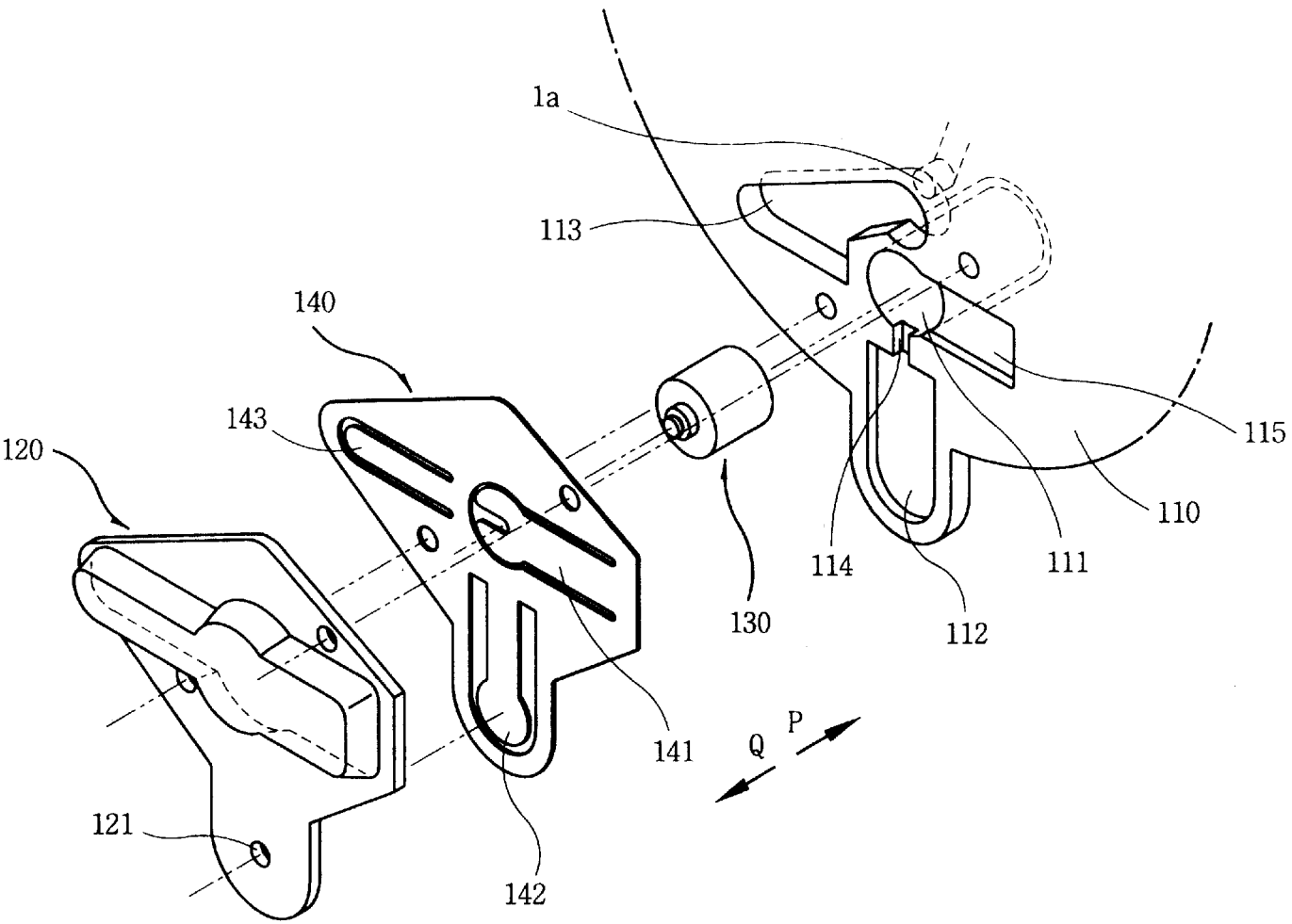
FIG. 6 is disassembled perspective view of the oil supply apparatus of the linear compressor in accordance with the present invention.

The oil supply apparatus of the linear compressor according to the present invention is to render the oil filled in the bottom of a casing V to flow into a compression unit C. As shown in FIGS. 4 through 6, The oil supply apparatus of the linear compressor includes: an oil feeder frame having an oil cylinder 111 at its center, an oil suction hole 112 communicated with the oil cylinder 111 at the lower side of the oil cylinder and an oil discharge hole 113 formed at one side of the oil cylinder; an oil cover having an oil suction opening 121 selectively communicated with the oil suction hole 112 at its lower portion, an oil communication space 122 selectively communicated with the oil cylinder 111 and the oil discharge hole 113, and being combined to the oil feeder frame 110 to cover the oil cylinder 111; an oil piston positioned between the oil feeder frame and the oil cover, being inserted in the oil cylinder and performing a slidable reciprocal movement to suck and discharge oil; and a single oil valve positioned between the oil cover and the piston, and having a piston support portion 141 formed horizontally cut, to which the side of the oil piston 130 directed to the oil cover 120 is engaged, a suction side opening and closing portion 142 vertically cut to be formed at the lower side of the piston support portion 141 so as to selectively open and close the oil suction opening 121 of the oil cover 120, and a discharge side opening and closing portion 143 horizontally cut to be formed to the piston support portion 141 at the side of the piston support portion 141 so as to selectively open and close the oil discharge hole 113 of the oil feeder frame 110.

In the oil supply apparatus of the linear compressor according to the present invention, a single oil valve 140 serves as a suction and a discharge valve at the same time.

Detailed explanation for a formation of the oil feeder frame 110 is as follows.

The oil suction hole 112 is vertically formed at the lower side of the oil cylinder 111 to communicate the oil inflow opening 121 of the oil cover 120 and the oil cylinder 111.

The oil discharge hole 113 formed at one side of the oil cylinder 111 communicate with the oil inflow path 1*a* so as to guide the oil discharged from the oil cylinder to the oil inflow path 1*a* formed inside the oil feeder frame 110.

The oil suction hole 112 and the oil discharge hole 113 are concavely formed, respectively, so that the suction side opening and closing portion 142 and the discharge opening and closing portion 143 of the oil valve 140 are smoothly rotated.

The oil suction hole 112 and the oil cylinder 111 are communicated to each other by an oil communication path 114 formed therebetween. The oil cylinder and the oil discharge hole 113 are selectively communicated with the oil communication space 115 by the discharge side opening and closing portion 143 of the oil valve 140.

The oil communication space serves to guide the oil discharged after being sucked to the oil cylinder 111 through the oil suction opening 121 of the oil cover and the oil suction hole 112 of the oil feeder frame 110, to the oil discharge hole 113 of the oil feeder frame 110. The oil communication space 115 is outwardly protruded to be formed so as to smoothly guide the oil flown from the oil cylinder 111 to the oil discharge hole 113.

Meanwhile, the oil piston 130 is formed in a rod, of which the side directed to the oil cover 130 is engaged with the central portion of the oil valve 140 of the piston support portion 141.

In the oil supply apparatus of the linear compressor constructed as described above according to the present invention, the oil valve 140 alternately opens and closes the oil inflow opening 121 of the oil cover 120 and the oil discharge hole 113 of the oil feeder frame 110 by the pressure difference formed in the oil cylinder 111 resulted from the reciprocal movement of the oil piston 130.

Referring to the drawings, the same reference numerals are given for the same parts as in the conventional art.

Reference number 3 denotes a cylinder, 6 denotes a piston, 9 denotes a suction pipe, 11 denotes a discharge cover, and 115 denotes a piston support movable hole.

The operation of the oil supply apparatus of the linear compressor of the present invention constructed as described above will now be explained.

When the frame 1 forming the compression unit C is oscillated in a horizontal direction as the compressor is driven, the oil cylinder 111 formed in the oil feeder frame 110 is accordingly oscillated in the horizontal direction.

Then, the oil piston 130 inserted in the oil cylinder 111 has an inertial force due to the reciprocal movement of the oil cylinder, causing repeatedly a pressure difference between the right and left regions of the oil piston 13, by which the oil filled in the casing V is sucked or discharged.

Figure 7A:
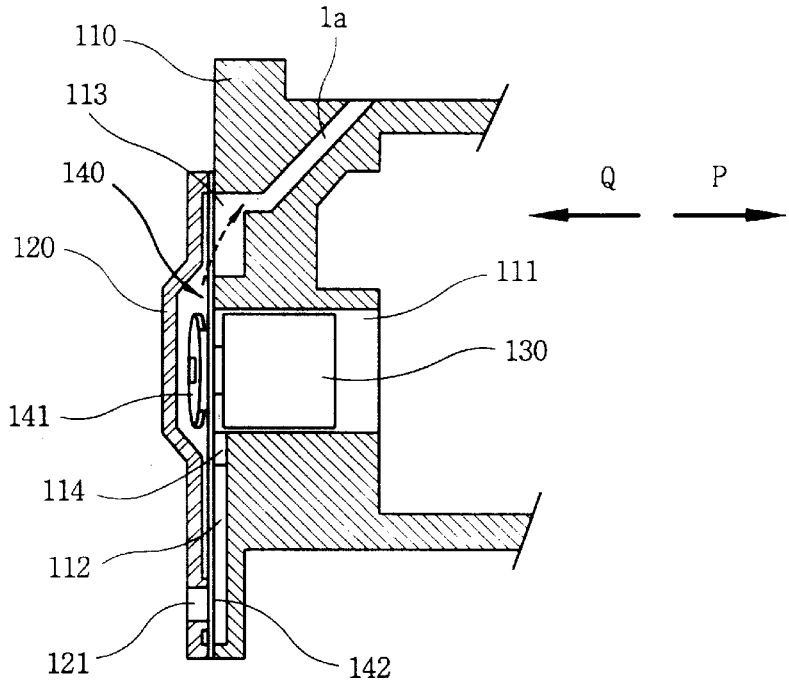
FIG. 7A is a vertical-sectional view showing an operation that oil flows into an oil suction path from the oil supply apparatus of the linear compressor in accordance with the present invention.

In detail, first, as shown in FIG. 7A, when the oil cylinder 111 moves in the 'P' direction, the oil piston 130 is moved in the 'Q' direction, that is, the opposite direction of the oil cylinder 111, so that the inner space 111*a* of the oil cylinder 111 is relatively highly pressurized.

Then, the suction side opening and closing portion 142 of the oil valve is moved in the 'Q' direction according to the pressure of the oil cylinder 111, so that the oil suction opening 121 of the oil cover 120 is closed, and thus, sucking of the oil is blocked.

At the same time, as the discharge side opening and closing portion 143 of the oil valve 140 is moved in the 'Q' direction to be opened, the oil cylinder 111 and the oil discharge hole 113 are communicated to each other, so that the oil sucked into the oil cylinder 111 passes through the oil communication space 122 and the oil discharge hole 113 and is flown into the contact sliding portion (sliding portion) of the compression unit C through the oil suction path 1*a*.

Figure 7B:
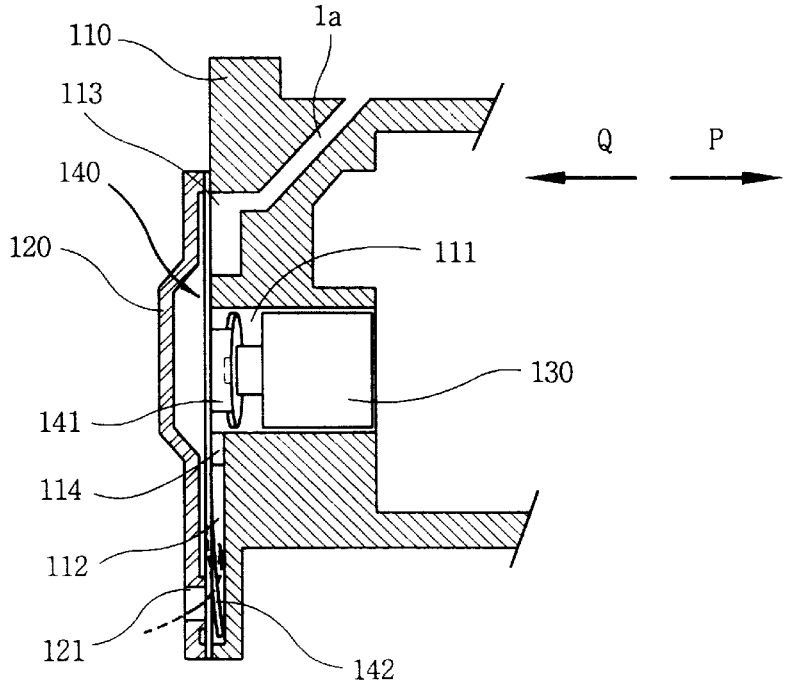
FIG. 7B is a vertical-sectional view showing an operation that oil flows into an oil suction hole from the oil supply apparatus of the linear compressor in accordance with the present invention.

Reversely, as shown in FIG. 7B, in case that the oil cylinder 21 moves in the 'Q' direction, the oil piston 130 is moved in the 'P' direction, so that the pressure of the inner space 111*a* of the oil cylinder 111 becomes relatively low.

Then, the suction side opening and closing portion 142 of the oil valve 140 submerged in the oil of the casing V is moved in the 'P' direction due to the pressure of the oil, so that the oil suction opening 121 is opened, and the oil sucked through the opened oil suction opening 121 flows into the oil cylinder 111 through the oil suction hole 112 and the oil communication path 114 of the oil feeder frame 110.

At the same time, the discharge side opening and closing portion 143 of the oil valve 140 that was pulled back is also moved in the 'P' direction, so that the gap between the oil discharge hole 113 and the oil communication space 122 of the oil cover is closed, and accordingly, the oil cylinder 111 and the oil discharge hole 113 does not communicate to each other.

As so far described, the oil supply apparatus of the linear compressor has a simple structure, and since the parts required for construction of the apparatus is reduced in number, advantageously reducing the assembly process.

Also, since the processing and assembling of the oil valve is facilitated, its productivity is highly improved.

In addition, compared to the conventional art in that the suction valve and discharge valve are separately provided and the suction valve is mounted inside the oil cylinder having a small diameter, in the present invention, the suction valve and the discharge valve are incorporated to a single oil valve and is mounted at outside the oil cylinder, so that installation of each part is facilitated and its productivity is enhanced.

Moreover, an elastic body is excluded from the construction elements of the oil supply apparatus so as to prevent the oil valve from contacting other structure during its operation of opening and closing, so that outputting and inputting of the oil can be properly controlled. Thus, the proper amount of oil is constantly supplied, improving a reliability of the compressor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. An oil supply apparatus of a linear compressor comprising:

an oil feeder frame having an oil cylinder, an oil suction hole communicated with the oil cylinder and an oil discharge hole;

an oil cover combined to the oil feeder frame to cover the oil cylinder and having an oil suction opening selectively communicated with the oil suction hole and an oil communication space selectively communicated with the oil cylinder and the oil discharge hole;

an oil piston positioned between the oil feeder frame and the oil cover, being inserted in the oil cylinder and performing a slidable reciprocal movement to suck and discharge oil; and a single oil valve positioned between the oil cover and the piston.

2. The apparatus according to claim 1, wherein the oil valve includes:

a piston support portion formed horizontally cut, to which one side of the oil piston is engaged;

a suction side opening and closing portion cut to be formed at the lower side of the piston support portion so as to selectively open and close the oil suction opening of the oil cover; and a discharge side opening and closing portion cut to be formed to the piston support portion at the side of the piston support portion so as to selectively open and close the oil discharge hole of the oil feeder frame.

3. The apparatus according to claim 1, wherein the oil discharge hole is formed inside the oil feeder frame, communicating with an oil inflow path supplying oil to a contact sliding portion of the compressor.

4. The apparatus according to claim 1, wherein the oil suction hole and the oil discharge hole are concavely formed, respectively.

5. The apparatus according to claim 1, wherein the oil cylinder and the oil suction hole communicate each other by an oil communication path formed therebetween.

6. The apparatus according to claim 1, wherein the oil cylinder and the oil discharge hole selectively communicate by the discharge side opening and closing portion.

7. The apparatus according to claim 1, wherein the oil communication space of the oil cover is formed to be outwardly protruded so as to smoothly guide the oil flown from the oil cylinder to the oil discharge hole.

* * * * *